US007805863B2

(12) United States Patent
Vennard et al.

(10) Patent No.: US 7,805,863 B2
(45) Date of Patent: Oct. 5, 2010

(54) MATERIALS MOVING BLADE

(75) Inventors: Robert G. Vennard, Regina (CA); Justin L. Tremblay, Regina (CA); Miles M. E. Evans, Regina (CA)

(73) Assignee: Degelman Industries Ltd., Regina, Saskatchewan (CA)

( * ) Notice: Subject to any disclaimer, the term of this patent is extended or adjusted under 35 U.S.C. 154(b) by 543 days.

(21) Appl. No.: 10/990,591

(22) Filed: Nov. 17, 2004

(65) Prior Publication Data

US 2005/0097786 A1 May 12, 2005

Related U.S. Application Data

(60) Division of application No. 10/630,327, filed on Jul. 30, 2003, now Pat. No. 6,845,576, and a continuation-in-part of application No. 29/185,854, filed on Jul. 3, 2003, now Pat. No. Des. 519,128, which is a continuation-in-part of application No. 29/171,447, filed on Nov. 21, 2002, now Pat. No. Des. 478,097.

(51) Int. Cl.
*E02F 3/76* (2006.01)

(52) U.S. Cl. ..... 37/266; 37/281; 172/832; 172/815

(58) Field of Classification Search ..... 37/442, 37/443, 444, 445, 398, 274, 281; 172/815, 172/784; 414/480, 779
See application file for complete search history.

(56) References Cited

U.S. PATENT DOCUMENTS 2,320,723 A * 6/1943 Gaylord ..... 37/250
2,393,432 A * 1/1946 Turner ..... 37/444
2,552,426 A * 5/1951 Hedley ..... 172/393
2,841,897 A * 7/1958 Duke ..... 172/815
2,882,620 A * 4/1959 MacDonald ..... 37/250
3,398,472 A * 8/1968 Leijon ..... 37/444
3,557,850 A * 1/1971 Owens et al. ..... 144/34.6
3,583,084 A * 6/1971 Farrell ..... 37/245
4,071,155 A * 1/1978 Hart et al. ..... 414/739
4,094,348 A * 6/1978 Wolf ..... 144/34.6
4,306,362 A 12/1981 Waterman
4,531,713 A 7/1985 Balboni
4,704,811 A * 11/1987 Jefferson ..... 37/364
4,707,936 A * 11/1987 Steinhoff ..... 37/264
5,046,271 A * 9/1991 Daniels ..... 37/231
5,129,169 A * 7/1992 Aubichon ..... 37/231
5,473,541 A 12/1995 Ishino et al.
5,535,830 A * 7/1996 Matsushita et al. ..... 172/7
5,599,135 A 2/1997 Delaurenti (Continued)

OTHER PUBLICATIONS

"Hydraulic Attachments for Loaers and Tractors", Sales Literature, Tink, Inc., 4th Edition: 1986, pp. 23.

(Continued)

*Primary Examiner*—Thomas A Beach
(74) *Attorney, Agent, or Firm*—Daniels Patent Law PLLC; Scott A. Daniels

(57) ABSTRACT

A materials pushing or moving blade for use with heavy equipment vehicles, for example, a bulldozer or loader, and more specifically to a method and apparatus for moving snow, specifically a snow moving blade having a reinforcing gusset for strengthening the extended sidewalls of the snow moving blade.

6 Claims, 10 Drawing Sheets

U.S. PATENT DOCUMENTS

| | | | | | |
|---|---|---|---|---|---|
| 5,724,755 | A | * | 3/1998 | Weagley | 37/233 |
| 5,729,919 | A | * | 3/1998 | DeBoer | 37/270 |
| 5,799,737 | A | | 9/1998 | Kamikawa | |
| 6,112,438 | A | | 9/2000 | Weagley | |
| 6,298,585 | B1 | * | 10/2001 | Boulet | 37/231 |
| 6,425,196 | B1 | * | 7/2002 | Weagley et al. | 37/270 |
| 6,439,279 | B1 | * | 8/2002 | Underwood | 144/34.6 |
| 6,470,604 | B1 | * | 10/2002 | Foster et al. | 37/267 |
| 6,481,506 | B2 | | 11/2002 | Okada | |
| 6,560,904 | B2 | * | 5/2003 | Guggino | 37/233 |
| D511,173 | S | * | 11/2005 | Fatemi | D15/11 |
| D511,174 | S | * | 11/2005 | Fatemi | D15/11 |
| D512,443 | S | * | 12/2005 | Fatemi | D15/11 |

OTHER PUBLICATIONS

"Efficient Collection of Leaves and Brush", *The Claw*, Sales Literature, 1998, pp. 10.
"Design Features", Tink, Inc. website, www.tinkinc.com, 2002, p. 1.
Avalanche brochure from Ledex industries (D001059-D001063).
Blaw-Knox asphalt paver advertisement.
Bonnell Industries Push 'N Plow brochure (D001238-D001242).
Buffalo Truck Equippers, Inc. brochure.
CAT D250E Articulated Truck brochure.
CWS Industries Ltd. Excavator Attachments and Couplers brochure.
CWS Industries Ltd. Wheel loader Attachments and Couplers brochure.
Degelman Dozer Blades brochure (P004809-P004813).
Degelman dozer manual from 1978 (Evans-11 and P005122-P005215).
Fair Mfg. snow equipment website screen shot.
Greg Daniels Deposition Mar. 26, 2008
Heinke Mfg. Corp. Montana Asphalt Topper brochure.
HL Machineries (D000984).
Hyundai HL720-3 wheel loader brochure.
Hyundai HL740-3 wheel loader brochure.
JRB Quick Couplers and Attachments for Loaders brochure.
Mann Pin on Rakes spec. sheet.
Misc. sketches with foreign language captions.
Monroe Snow & Ice Control brochure.
O. Blodget, Design of Weldments; Ronnblom disclosure (P004690).
Orsolini drawing /Daniels plow public use (Greg Daniels Dep.Exhibits 2-6).
Pro-Tech fold-out pusher advertising brochure (D001086).
Pro-Tech Material Handling Box (P000224).
Tenco Operator's Manual (P008441-P008508).
Tractor Drawn Scraper, Folding-Wing Scraper advertisement.
Ted Hosmer snowplowing pictures of plows.
Tenco Machinery Ltd. Website screen shots (Tenco).
Tenco Machinery, Ltd. 1998 snowblowers advertisement (Tenco)-(004778, P004795-96, P008441-P008512).
Tenco snowblower spec sheets brochures and pictures (Tenco) Dec. 1999 Model TC 272 19 pgs with P008432-P008440.
Various snow removal models (SD-15-17).

* cited by examiner

MATERIALS MOVING BLADE

This Application is a divisional of U.S. patent application Ser. No. 10/630,327 filed Jul. 30, 2003, now U.S. Pat. No. 6,845,576 entitled MATERIALS MOVING BLADE which is a Continuation-in-Part of U.S. Design patent application 29/171,447, filed Nov. 21, 2002 now U.S. Pat. No. D 478,097 entitled; SNOW MOVING APPARATUS and application No. 29/185,854, filed Jul. 3, 2003 now U.S. Pat. No. D 519, 128 also entitled; SNOW MOVING APPARATUS.

FIELD OF THE INVENTION

The present invention relates to a materials pushing or moving blade for use with heavy equipment vehicles, for example, a bulldozer or loader and more specifically to a method and apparatus for moving snow, specifically a snow moving blade having a reinforcing gusset for strengthening the extended sidewalls of the snow moving blade.

BACKGROUND OF THE INVENTION

In general, heavy equipment, for example, a bulldozer, loader, etc., for moving materials, e.g., earth, snow, refuse, etc., are provided with a main blade which is attached to a hydraulically articulated blade adjustment device on the vehicle. A general materials moving blade is a substantially planar, rectangular piece of steel which may have a substantially vertically oriented curve or bend along its length to facilitate materials handling and moving. It is also known that these blades may be divided into horizontally adjacent blade segments for materials handling purposes as well. The blades are also often provided with a replaceable or reinforced lower edge to replace or prevent damage to the blade from the ground surface over which the blade is pushed, pulled or carried by the machinery.

For purposes of snow removal, such above described blades are provided with a substantially longer longitudinal length than conventional earth moving blades due to the generally lighter and more consistent nature of snow relative to other materials. The longer length facilitates the clearing of large swaths of, for example, roads, parking lots, loading docks etc., of commercial and industrial centers during the winter months.

In order to contain the snow within the span or longitudinal length of the blade, sidewalls are often attached to the ends of the blade extending substantially perpendicularly out from the blade, i.e., parallel to the direction of travel of the equipment. This ensures that as much snow as possible is maintained in front of the blade, i.e., snow does not spill off the ends of the main blade. The sidewalls are usually a single, relatively thin piece of steel to keep the blade as light weight as possible A problem that arises with such apparatus is the lack of strength in the connection or joint between each sidewall attached at opposing ends of the blade. The substantially perpendicular welded joint attaching each sidewall to the blade, as is usual in the art, provides attachment but only minimal support for the relatively thin sidewall which extends a desired distance out in front of the main blade. Without any support other than the joint with the main blade, the thin sidewalls can be easily damaged, and are particularly susceptible to being bent outwards by sufficient snow loads within the confines of the box blade, especially as the machine pushes the blade with a load.

In order to overcome this problem of stability and to better secure the sidewalls to the main blade and prevent such damage, a support bar, tube, or a multiplicity of such bars or tubes are often welded between each sidewall and main blade. The support(s) are generally horizontal to the ground, i.e., perpendicular relative to but spaced from the substantially vertical joint between the sidewall and main blade. The support thus forms a triangular-type brace between the front surface of the main blade and the inner side of the sidewall to provide further rigidity and support to the sidewall.

These previously known supports present several problems, including a space between the support and the joint in which objects could be caught up or entangled. Also, such a horizontal support tends to form a shelf or trap for snow, ice or other debris which cannot become loosened without the operator intervening. In snow plowing, snow may build up in and around these supports and in order to remove such build up of snow, the operator must strike the blade upon the ground surface to loosen the snow or must physically remove the buildup by exiting from the cab and scraping the snow out, all of which may cause damage and time delays with respect to snow removing.

OBJECT AND SUMMARY OF THE INVENTION

Wherefore, it is an object of the present invention to overcome the above mentioned shortcomings and drawbacks associated with the prior art.

Another object of the present invention is to provide a materials moving blade having sidewalls which are strengthened relative to the main blade by a conic section gusset.

A further object of the invention is to provide the gusset with a substantially larger base portion adjacent the connected ends of the main blade and sidewall to a substantially smaller apex portion adjacent the extended free end of the sidewall.

Yet another object of the present invention is to provide a gusset for strengthening a joint between substantially perpendicular members of a heavy equipment blade which easily sheds materials being plowed, for example, snow, ice and/or earth where the materials being moved or plowed contact only a contiguous forward facing surface to facilitate disengagement of the material from the blade or bucket.

A still further object of the present invention is to provide an easy to manufacture and economical support gusset to provide increased strength and stability of the material mover with the least amount of additional weight to the blade or bucket.

The present invention also relates to a materials moving blade for attachment to a vehicle comprising a main blade (2) defined by a first and second ends, a top edge (18), a bottom edge (20) and a front and back surfaces (4, 6); a first sidewall (26) and a second sidewall (28) attached to and extending substantially perpendicular from the respective first and second ends of the main blade (2); a first support gusset extending from a larger base portion connected to the front surface (4) of the main blade (2) to a smaller apex portion connected to the first sidewall (26); a second support gusset extending from a larger base portion connected to the front surface (4) of the main blade (2) to a smaller apex portion connected to the second sidewall (28).

The present invention also relates to a materials moving box blade (1) comprising a main blade (2) defined by a first and second ends, a top edge (18), a bottom edge (20) and a front and back surfaces (4, 6); a first sidewall (26) and a second sidewall (28) attached to and extending substantially perpendicular from the respective first and second ends of the main blade (2); a first support gusset extending from a larger base portion connected to the front surface (4) of the main blade (2) to a smaller apex portion connected to the first sidewall (26); a second support gusset extending from a larger base portion connected to the front surface (4) of the main blade (2) to a smaller apex portion connected to the second sidewall (28).

The present invention also relates to a method of strengthening a materials moving box blade (1), the method comprising the steps of providing a main blade (2) defined by a first and second ends, a top edge (18), a bottom edge (20) and a front and back surfaces (4, 6); attaching a first sidewall (26) and a second sidewall (28) to and extending substantially perpendicular from the respective first and second ends of the main blade (2); attaching a first support gusset extending from a larger base portion connected to the front surface (4) of the main blade (2) to a smaller apex portion connected to the first sidewall (26); attaching a second support gusset extending from a larger base portion connected to the front surface (4) of the main blade (2) to a smaller apex portion connected to the second sidewall (28).

BRIEF DESCRIPTION OF THE DRAWINGS

The invention will now be described, by way of example, with reference to the accompanying drawings in which.

DETAILED DESCRIPTION OF THE INVENTION

Figure 1:
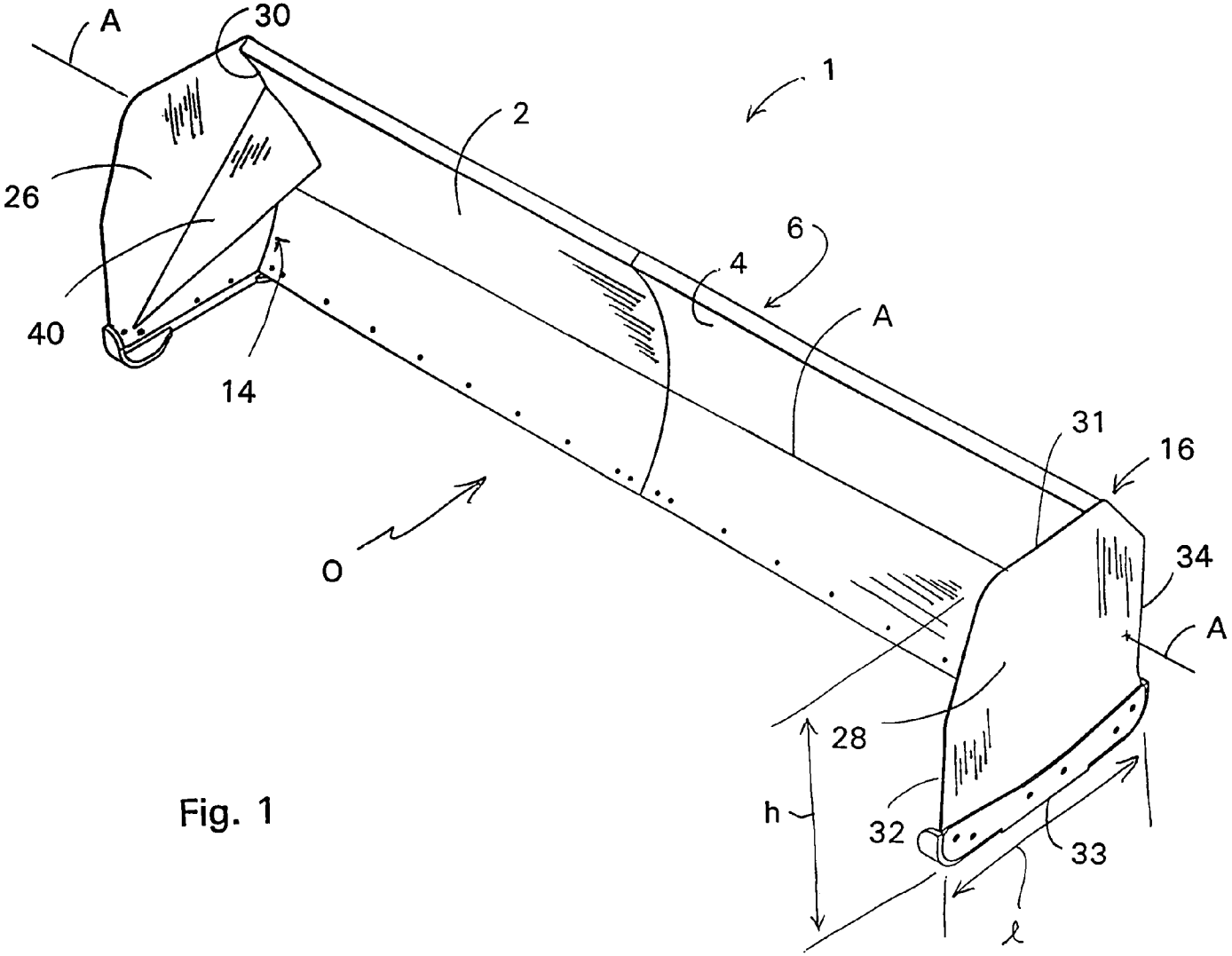
FIG. 1 is a front perspective view of the materials moving apparatus.
Figure 2:
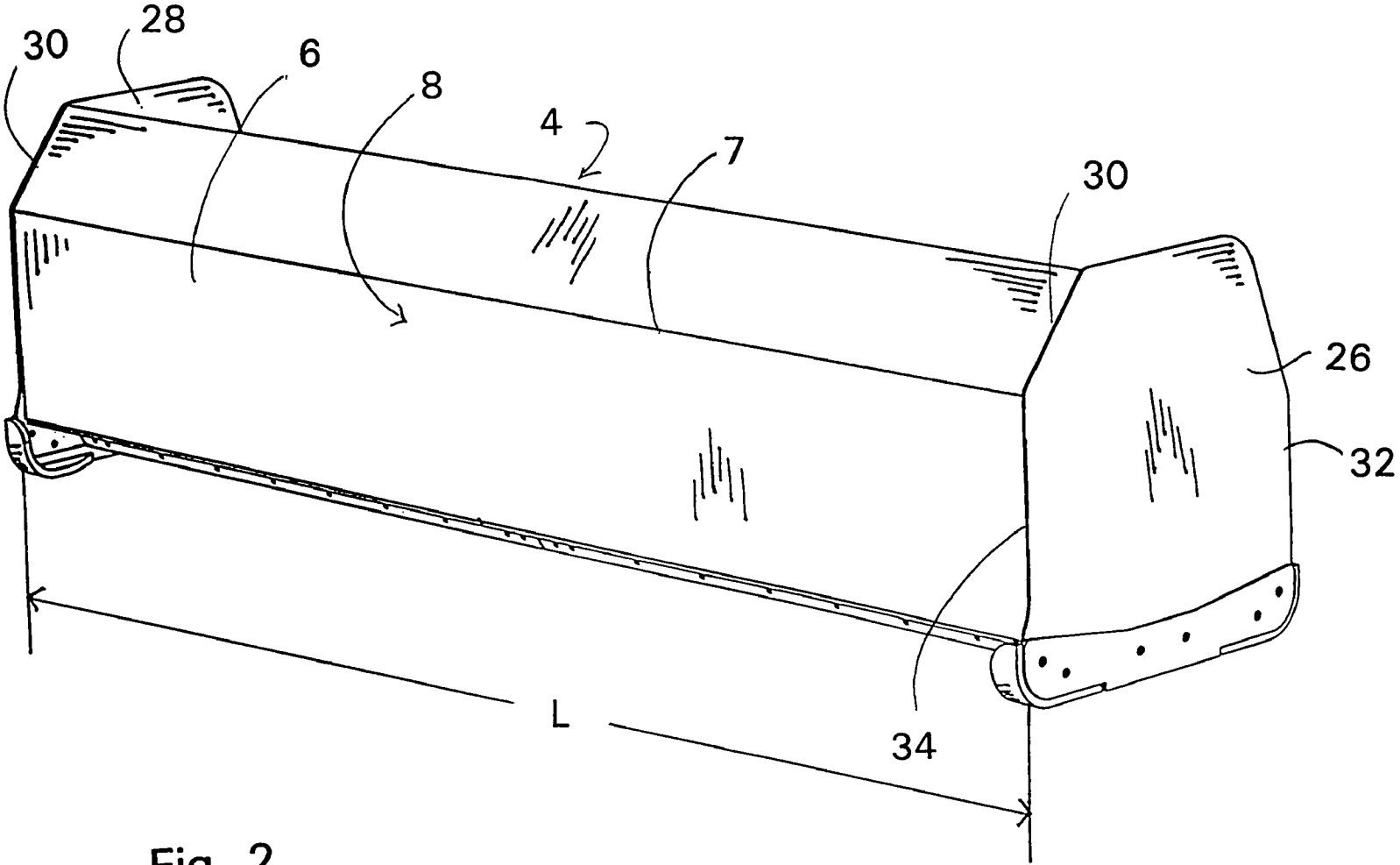
FIG. 2 is a rear perspective view of the materials moving apparatus.

In conjunction with FIGS. 1 and 2, a brief description concerning the various components of the present invention will now be provided. As can be seen in this embodiment, the present invention provides a box blade 1 having main blade 2 extending along a longitudinal axis A for a longitudinal length L. The main blade 2 may be planar, i.e., flat, relative to the longitudinal axis A or curved and/or bent at an angle substantially about the longitudinal axis A running the longitudinal length L of the blade 1 to facilitate retention of materials being moved by the blade 1.

The main blade 2 has a front surface 4 for engaging material and a back surface 6 generally for supporting mounting hardware. The main blade 2 may be provided as either a single sheet of metal or, as shown in conjunction with FIG. 2, the main blade 2 may be a double walled design having a spaced apart front and rear wall 8, 10, respectively. A double walled design may include the front and rear walls 8, 10 having a substantially different curvature, bend or orientation about the longitudinal axis A, for example, the front wall 8 may be curved as in FIG. 1, and the back wall 10 may have a bend 7 as shown in FIG. 2. Also due to the space between the front and back walls 8, 10, the double walled design can also help stop damage to the hydraulics or any vehicle connection devices attached to the rear wall 10 of the main blade 2 where the front wall 8 is damaged by an object. In any event, whether the main blade 2 is single or double walled, the main blade 2 is defined having the front surface 4 and the back surface 6.

Figure 3:
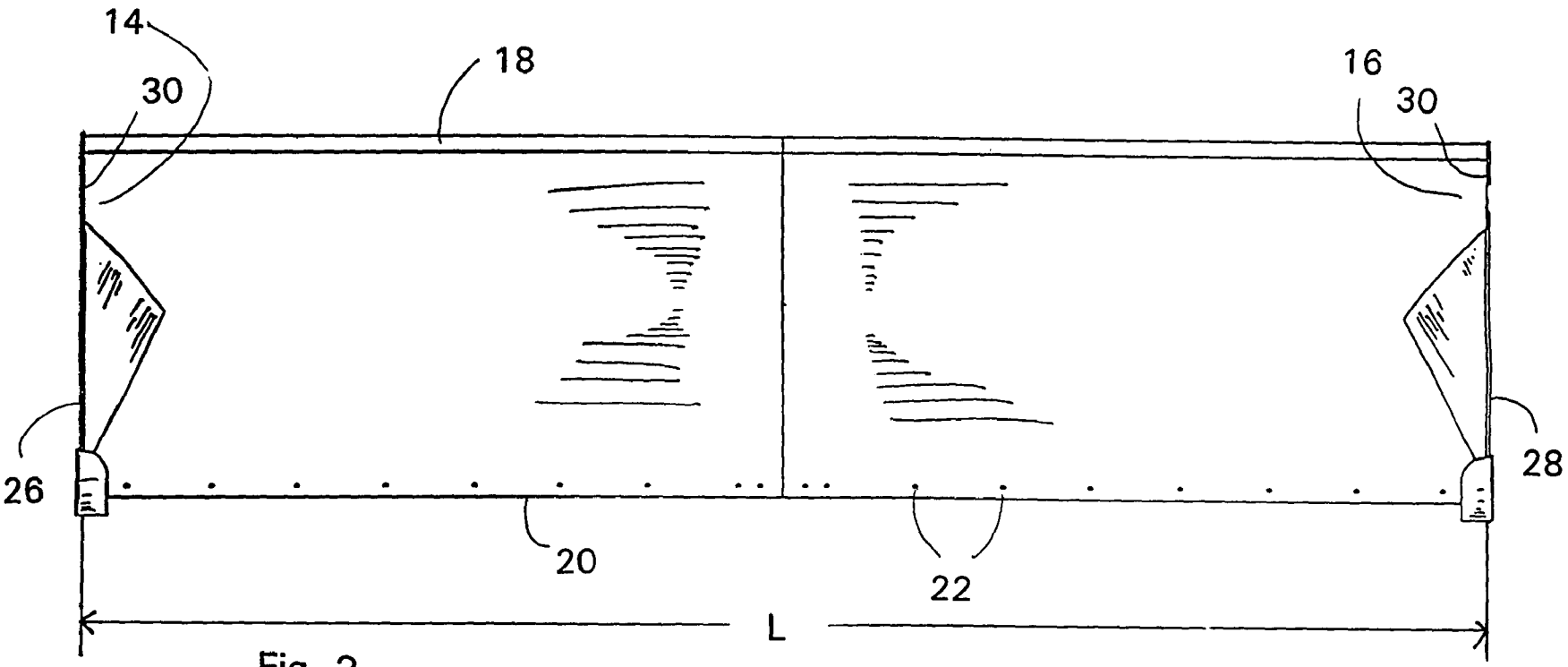
FIG. 3 is a front elevational view of the materials moving apparatus.
Figure 4:
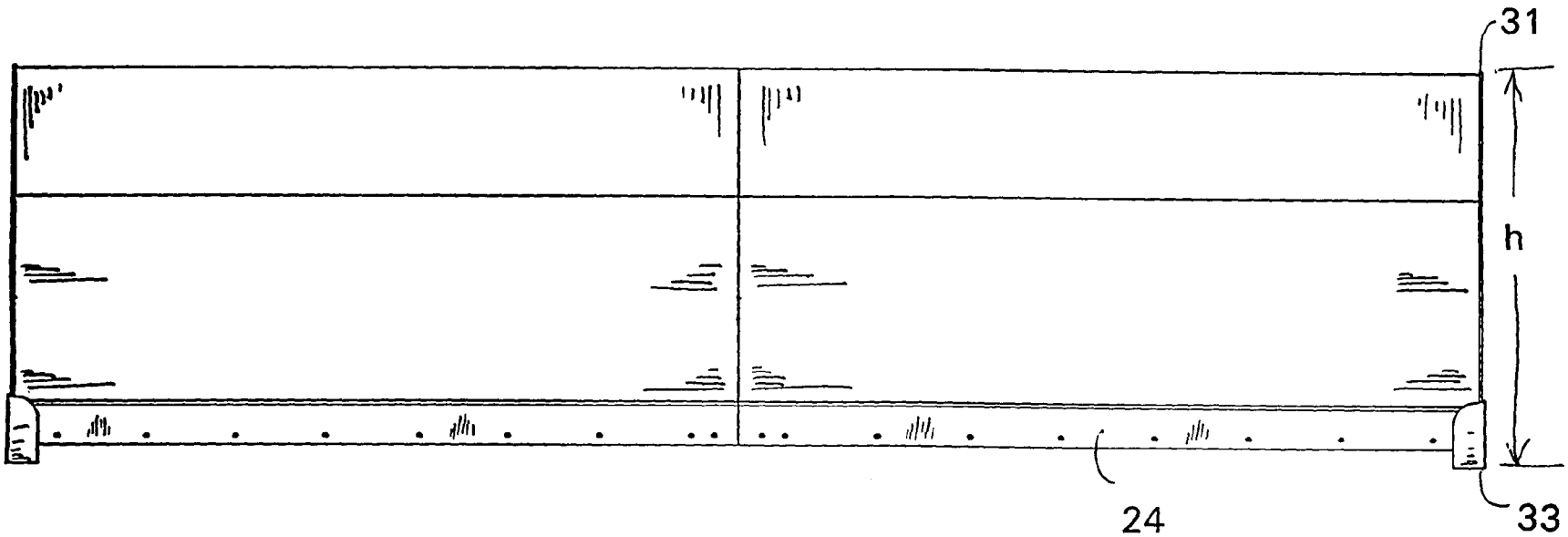
FIG. 4 is a rear elevational view of the materials moving apparatus.
Figure 5:
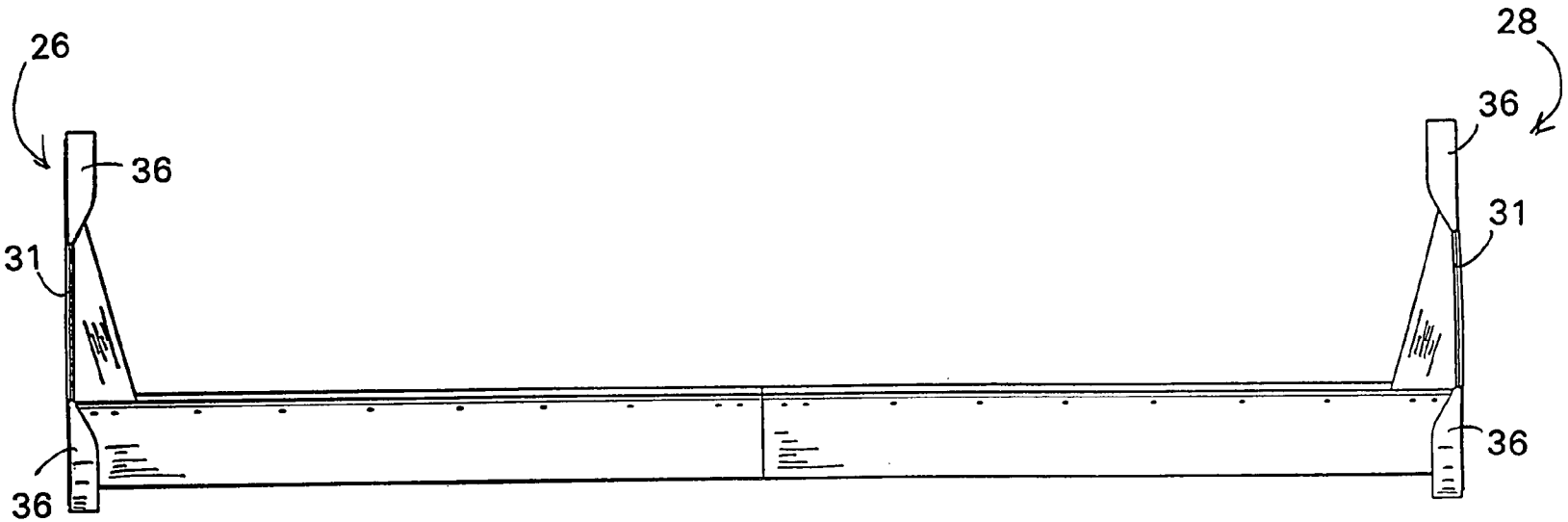
FIG. 5 is a bottom plan view of the materials moving apparatus.
Figure 6:
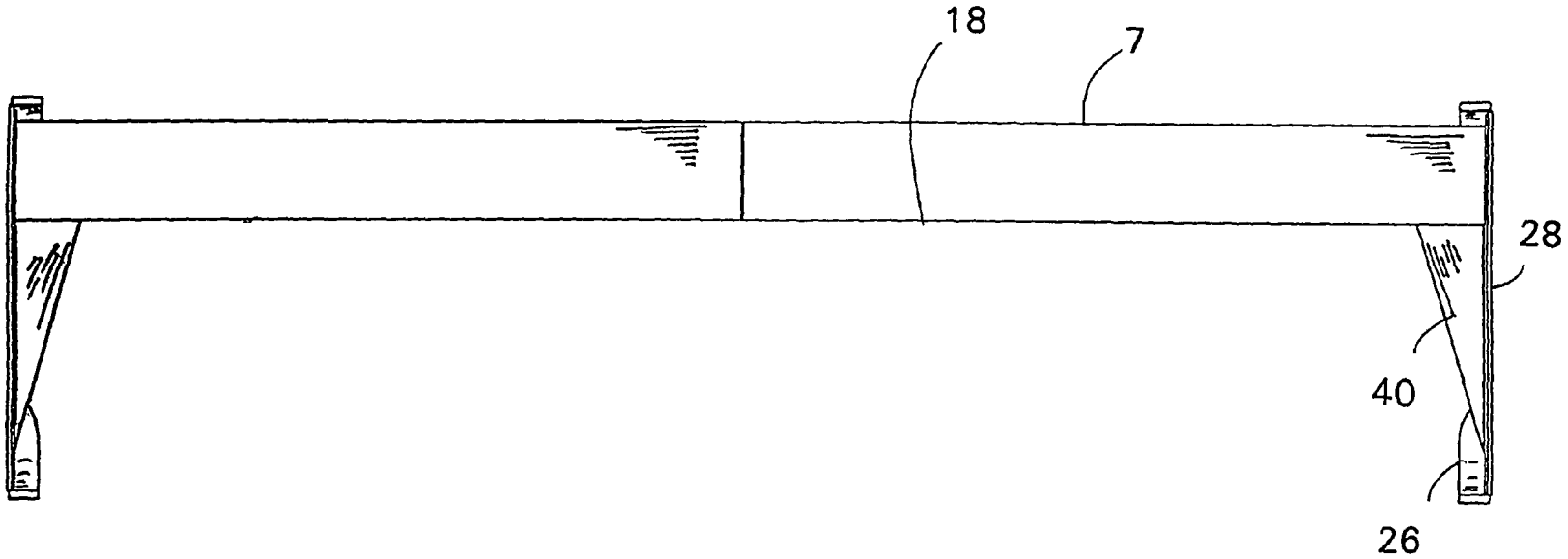
FIG. 6 is a top plan view of the materials moving apparatus.
Figure 7:
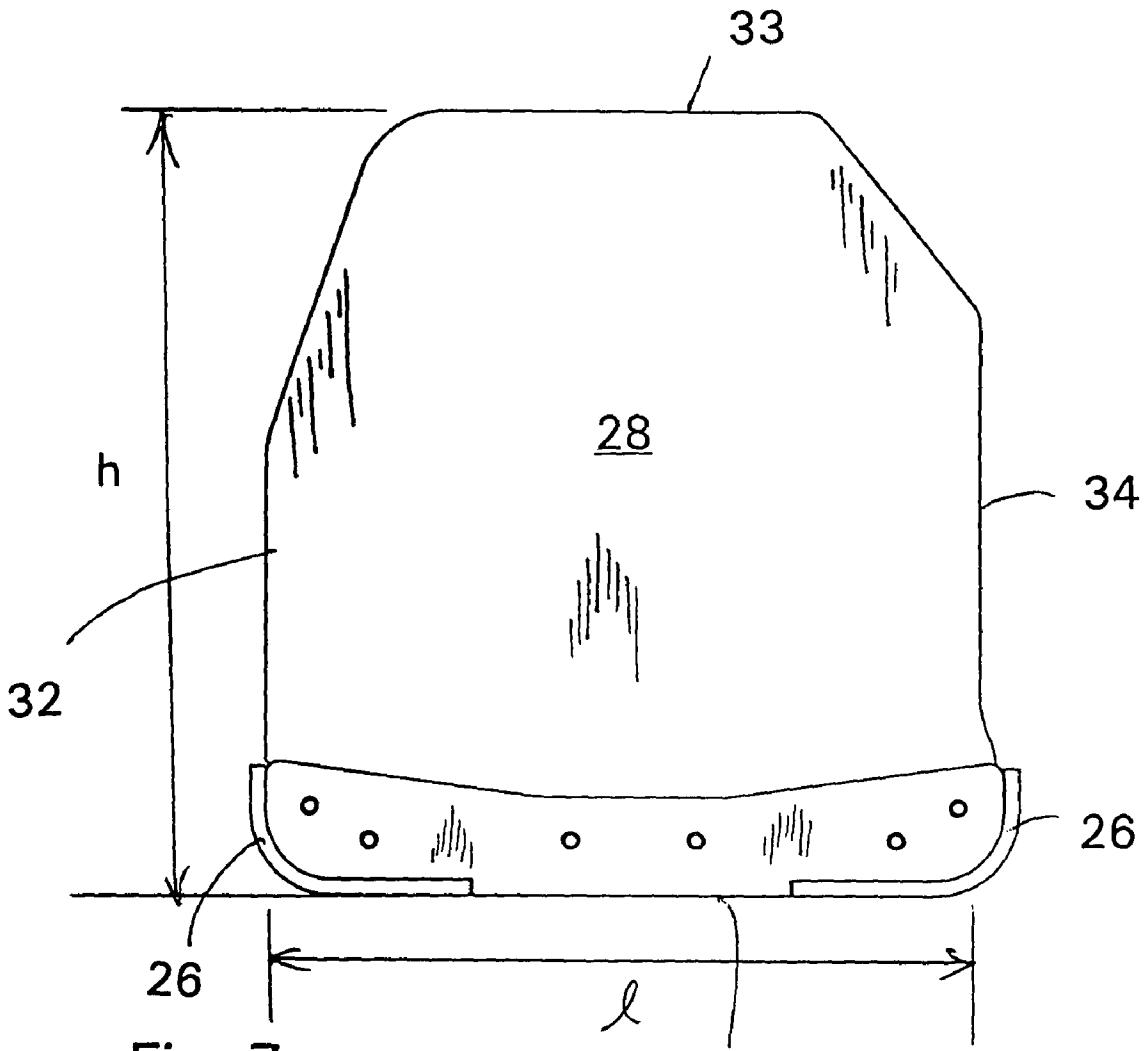
FIG. 7 is a left side view of the materials moving apparatus.
Figure 8:
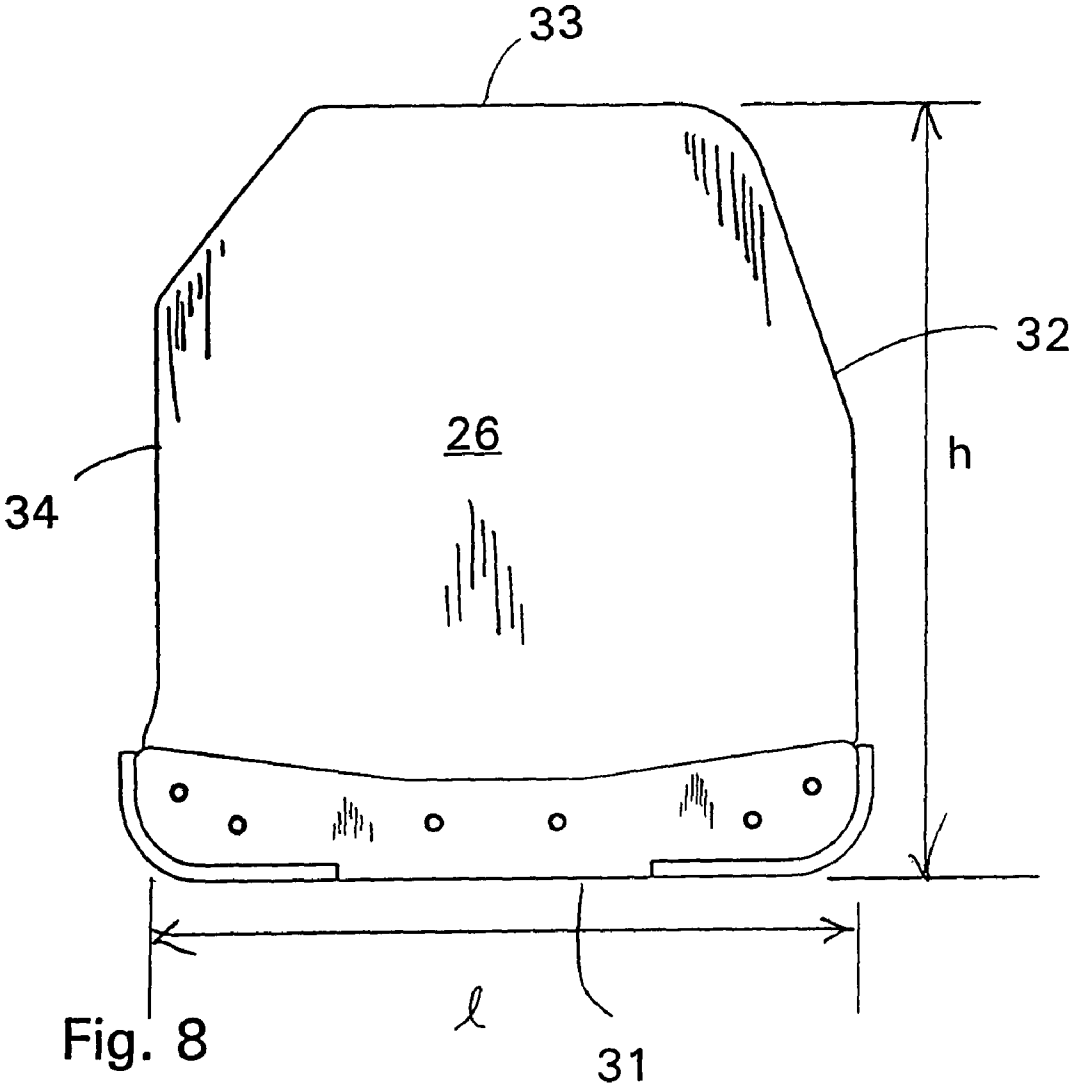
FIG. 8 is a right side view of the materials moving apparatus.

Observing FIGS. 3 and 4, besides the front and back surfaces 4, 6, the main blade 2 has opposing first and second side ends 14, 16, a top edge 18 and a bottom edge 20. The bottom edge 20 is normally in contact or very close to the ground during cutting and pushing operations, especially during snow clearing operations, although it may be raised above the ground in certain situations for transport and providing necessary clearance for certain objects on the ground, curbs, reflectors, etc. The bottom edge 20 of the main blade 2 is often provided with attachment points or bolt holes 22 (as shown) to facilitate the attachment of a replaceable edge 24 which can be fastened to the bottom edge 20, for example, by rivets or bolts. Such a replaceable edge 24 is important for protecting the main blade 2 from wear against the ground as well as minimizing damage from objects which the blade may encounter.

As is well known in the colder latitudes of the world, heavy earth moving equipment vehicles, e.g., graders, scrapers, loaders, etc., are often used to facilitate the removal of snow, for example, at airports, large commercial parking and vehicle loading lots, etc. The heavy equipment is usually provided with the box blade 1 as shown in FIGS. 1-4 and designed specifically for snow removal. The box blade 1 is used in place of or attached to the main regular bucket or blade of the heavy equipment. In addition to the above described main blade 2, box blades 1 are provided with an opposing first and second side walls 26, 28 to better entrap the snow and facilitate the removal thereof.

The first sidewall 26 and the second sidewall 28 are attached to the respective first and second ends 14, 16 of the main blade 2. The first and second sidewalls 26, 28 are, in general, welded or connected in some manner, as known in the art, to the respective first and second ends 14, 16 of the main blade 2 and are generally formed of a single planar piece of material for purposes of conserving weight. The intersection between each connected sidewall 26, 28 and the respective side edges 14, 16 of the main blade 2 defines a substantially vertical connection joint 30 running perpendicular to the longitudinal axis A of the main blade 2. The box blade 1 is formed by providing the first and second sidewalls 26, 28 with a height h defined by a sidewall top and bottom edges 31, 33 and a length l defined between the front and rear sidewall edges 32, 34. These edges may define overall a substantially square or rectangular end wall, although other shapes could be contemplated as well.

For purposes of discussion, the following description relates to only the first connection joint 30 between the first side edge 14 of the main blade 2 and the first sidewall 26, as each opposing sidewall is joined in the same manner and with the same components and structures, only a description of one side is believed necessary. The first sidewall 26 is connected near or adjacent its rear edge to the respective first side edge 14 of the main blade 2, along the connection joint 30. From the connection joint 30, the sidewall 26 extends substantially perpendicularly with respect to the main blade 2, and radially from the longitudinal axis A, along its length l to space the front sidewall edge 32 at a substantial distance relative to the rear sidewall edge 34 from the longitudinal axis A of the blade.

As seen in FIGS. 5-8, the bottom edge 31 of the sidewall may be provided with a skid foot, or a plurality of skid feet 36, in order to protect the sidewall bottom edge 31 and facilitate the passage of the box blade 1 itself across a ground surface without damage. The skid feet 36 may be either welded or bolted to the bottom edge 31 of the first and second sidewalls 26, 28 in order to facilitate replacement in the event of damage or breakage.

With the sidewalls 26, 28 attached to each end 14, 16 of the main blade 2, the above described arrangement essentially defines a 3-sided box structure having a forward facing opening O to push and contain the materials being moved, thus the term "box blade" as is known in the art. With respect to such box blades, as is readily apparent to one of ordinary skill in the art, the farther the front sidewall edge 32 extends from the respective connection joint 30 with the main blade 2, the more flexible the first and second sidewalls 26, 28 become due to the increasing weight of the sidewall as it extends farther from the connection joint 30 thus creating a greater moment arm about the connection joint 30.

Figure 9:
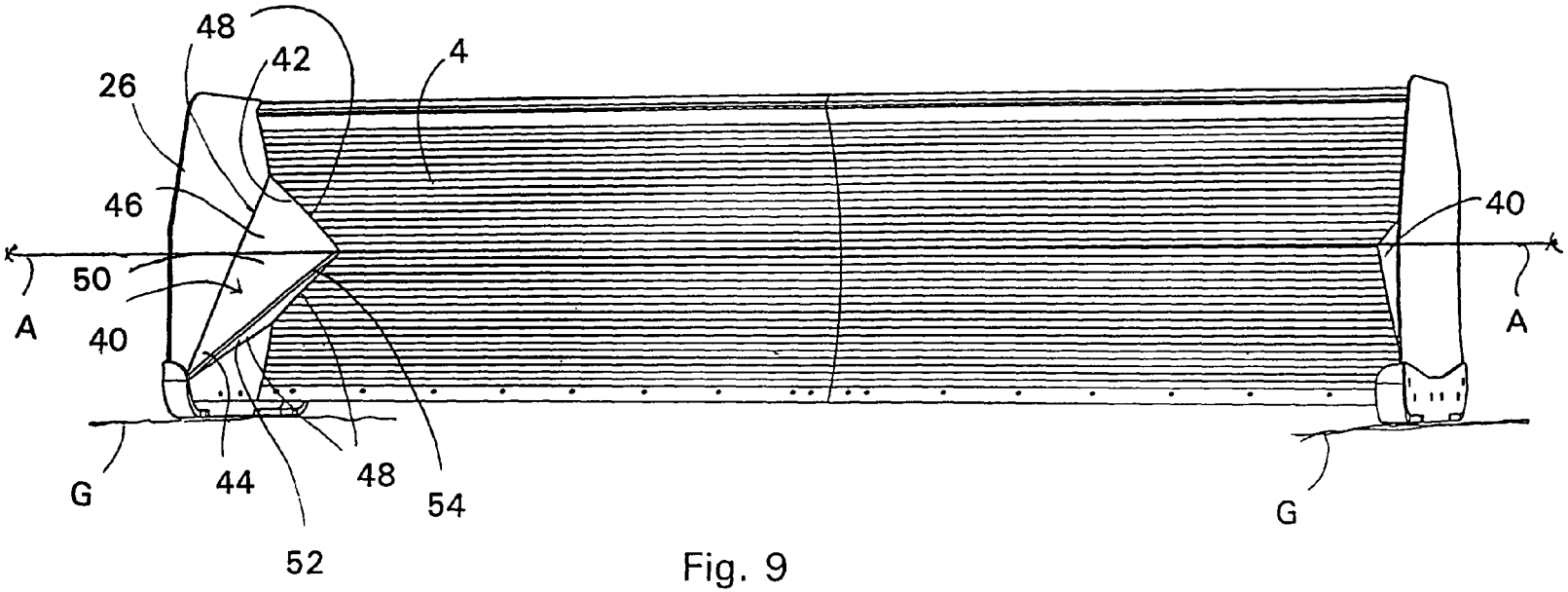
FIG. 9 is a front perspective view of the materials moving apparatus.

Turning to FIG. 9, in order to maintain the integrity of the box blade 1, specifically the rigidity of the main blade 2, and especially the first and second sidewalls 26, 28, relative thereto, a strengthening gusset 40 is incorporated with each connection joint 30 and between the sidewall and the main blade 2 to stabilize each sidewall relative to the main blade 2.

Each gusset 40 is formed as a substantially conic section, i.e., a partial cone, having a base portion 42 attached to and extending radially from the front surface 4 of the main blade 2 to an apex portion 44 spaced therefrom and attached on the inner surface of the sidewalls 26, 28. The apex portion 44 may extend substantially the length of the inner surface of the sidewall to be situated substantially near the front edge 32 or forward edge of the respective sidewall.

The conic section gusset 40 is provided with a contiguous outer surface 46 and an outer supporting edge 48 which is joined to the respective front surface 4 of the main blade 2 and the inner surface of the sidewall 26. The attachment between the main blade 2, the sidewall 26 and the gusset 40 is complete, i.e., it defines a contiguous, usually welded gusset seam attaching the entire outer edge 48 of the conic section gusset to the box blade 1. Thus, the gusset 40, in conjunction with the sidewall 26 and main blade 2, presents an uninterrupted or unbroken face to any material being pushed or moved In the present embodiment, the contiguous outer surface 46 of the conic section gusset 40 is formed by a first and second substantially planar surfaces 50, 52 aligned at an angle with respect to one another. The first and second planar surfaces 50, 52 are angled with respect to one another along a bend 54 which extends substantially the length of the conic section from the base portion 42 connected to the main blade 2 to the apex portion 44 connected to the first sidewall 26.

Figure 10:
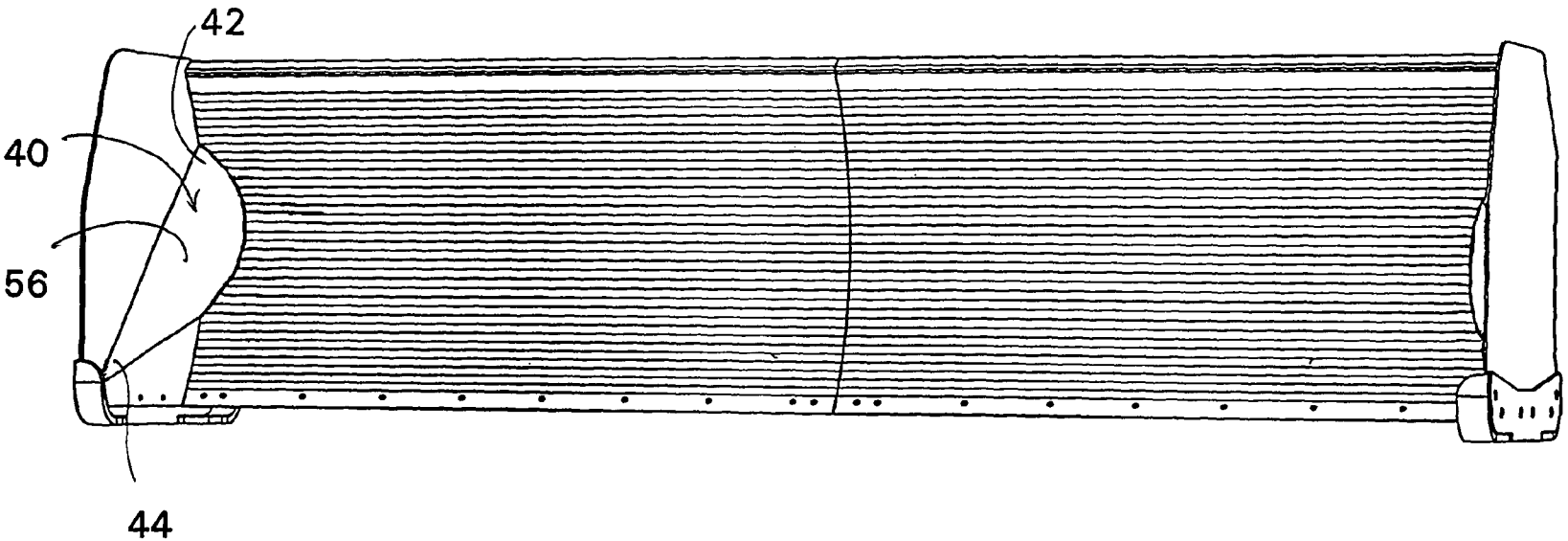
FIG. 10 is a front perspective view of an embodiment of the materials moving apparatus.

In another embodiment as seen in FIG. 10, the cone may have a substantially hemispherical or semi-hemispherical surface 56 having a radius of curvature, for instance, a semi-circular section. It is to be understood that the conic section gusset 40 may also be formed with a plurality of adjacent surfaces to effectively produce the conic section provided with a respective number of angles to effect a number of differently surfaced conic sections. Generally, the conic section gusset 40 is integrally formed from a single piece of material, for example, steel, although it could be made of several separate sections joined together to form the gusset 40. In any event, each adjacent surface of a multi-surface conic section gusset is provided with a wider base portion 42 and a narrower apex portion 44 joined to the respective main blade 2 and sidewall 26 as described above.

The use of such a conical shape is particularly important in that the gusset 40 may be formed from a single piece of material which may be bent or curved into the desired surface shape and then welded or connected to the main blade 2 along the outer edge 48. This provides not only a structurally strong gusset 40 and unbroken material moving face, but also provides ease of manufacture and application of the gusset 40 to the main blade 2 and first sidewall 26.

It is well known to those in the mechanical field that in order to reduce the moment of an arm about an axis, the weight or mass of the arm can be reduced. It is an important aspect of the present invention that as the gusset 40 extends from the main blade 2 and the longitudinal axis A, the cone gusset 40 has the larger base portion 42 decreasing to the more narrow apex portion 44 as it extends radially away from the main blade 2 and consequently the longitudinal axis A. With the first and second sidewalls 26, 28 extending perpendicular to the axis, this decreased mass of the apex portion 44 of the cone gusset is particularly helpful in lowering the moment of the first and second sidewalls 26, 28 and the gusset 40 about the horizontal axis.

In the above described embodiment of the present invention, the cone gusset 40, which also extends radially and substantially perpendicular relative to the longitudinal axis A of the main blade 2, depends downward from the base portion 42 located higher up relative to the ground surface, to the apex portion 44 situated closer to the ground G and attached adjacent the lower edge 31 and front edge 32 of the sidewall 26. Such a downward depending gusset 40 inherently also aligns the contiguous surfaces 50 and 52 of the conic section gusset 40 not only inward relative to the box blade 1, but also radially downward towards the ground which facilitates the shedding of snow and/or earth or other material from the gusset 40.

Since certain changes may be made in the above described improved materials moving apparatus without departing from the spirit and scope of the invention herein involved, it is intended that all of the subject matter of the above description or shown in the accompanying drawings shall be interpreted merely as examples illustrating the inventive concept herein and shall not be construed as limiting the invention.

We claim:

1. A materials moving vehicle carrying a materials moving blade comprising a main blade and at least a sidewall joined by a metal reinforcement, the metal reinforcement comprising:

a multi-planar support wall having at least a first and second planar wall sections defining a volume decreasing from a larger base portion to a smaller end portion of the support wall;

the base portion is attached to a surface of main blade and the end portion is attached to a surface of the adjacent sidewall and the base portion of the reinforcement extends between a top corner and a bottom corner affixed at an intersection of the main blade and the sidewall and the top corner and the bottom corner of the reinforcement are each spaced from the top edge and bottom edge of the main blade;

the multi-planar support wall is formed from a contiguous piece of steel provided with at least a bend between the first and second planar wall sections and defines an entirely enclosed volume between the multi-planar support wall, the main blade and the sidewall; and wherein the end portion of the support wall is attached to the sidewall substantially horizontally spaced from and vertically lower than the attachment of the base portion of the support wall to the main blade.

2. The metal reinforcement as set forth in claim 1, wherein the multi-planar support wall further comprises a first corner attached to an intersection of the sidewall and main blade.

3. The metal reinforcement as set forth in claim 1, wherein the multi-planar support wall further comprises a second corner also attached to the intersection of the sidewall and main blade and spaced from the first corner.

4. A volumetric reinforcement for a joint between a main blade and a sidewall of a materials moving blade comprising:

a multi-planar wall defining a decreasing volume extending away from the main blade and along a surface of the sidewall;

a base portion connected to a surface of the main blade and an apex having a smaller cross-section relative to the base portion connected to the surface of the sidewall at a point spaced from a lower edge of the sidewall;

a contiguous corner of the multi-planar wall extending from the base portion and substantially a mid-height of the main blade to the apex near the lower edge of the sidewall; and wherein a bottom edge of the volumetric reinforcement is angled downward relative to the lower edge of the sidewall from the base portion connected to the surface of the main blade to the apex connected to the sidewall.

5. The volumetric reinforcement support as set forth in claim 4, wherein the volumetric support is defined by an outer surface having the shape of one of a cone, a wedge, a tetrahedron and a cylinder.

6. The volumetric reinforcement support as set forth in claim 4, wherein the multi-planar volume of the volumetric reinforcement comprises a plurality of planar surfaces at least one of which having the shape of a triangle.

* * * * *

US007805863C1

(12) EX PARTE REEXAMINATION CERTIFICATE (9679th)

United States Patent
Vennard et al.

(10) Number: US 7,805,863 C1
(45) Certificate Issued: May 28, 2013

(54) MATERIALS MOVING BLADE

(75) Inventors: Robert G. Vennard, Regina (CA); Justin L. Tremblay, Regina (CA); Miles M. E. Evans, Regina (CA)

(73) Assignee: Degelman Industries Ltd., Regina, Saskatchewan (CA)

Reexamination Request:
No. 90/012,597, Sep. 14, 2012

Reexamination Certificate for:

| | |
|---|---|
| Patent No.: | **7,805,863** |
| Issued: | **Oct. 5, 2010** |
| Appl. No.: | **10/990,591** |
| Filed: | **Nov. 17, 2004** |

Related U.S. Application Data

(60) Division of application No. 10/630,327, filed on Jul. 30, 2003, now Pat. No. 6,845,576, and a continuation-in-part of application No. 29/185,854, filed on Jul. 3, 2003, now Pat. No. Des. 519,128, which is a continuation-in-part of application No. 29/171,447, filed on Nov. 21, 2002, now Pat. No. Des. 478,097.

(51) Int. Cl.
*E02F 3/76* (2006.01)

(52) U.S. Cl.
USPC ..... 37/266; 37/281; 172/815; 172/832

(58) Field of Classification Search
USPC ..... 37/266, 281; 172/815, 832
See application file for complete search history.

(56) References Cited

To view the complete listing of prior art documents cited during the proceeding for Reexamination Control Number 90/012,597, please refer to the USPTO's public Patent Application Information Retrieval (PAIR) system under the Display References tab.

*Primary Examiner* — Matthew C. Graham

(57) ABSTRACT

A materials pushing or moving blade for use with heavy equipment vehicles, for example, a bulldozer or loader, and more specifically to a method and apparatus for moving snow, specifically a snow moving blade having a reinforcing gusset for strengthening the extended sidewalls of the snow moving blade.

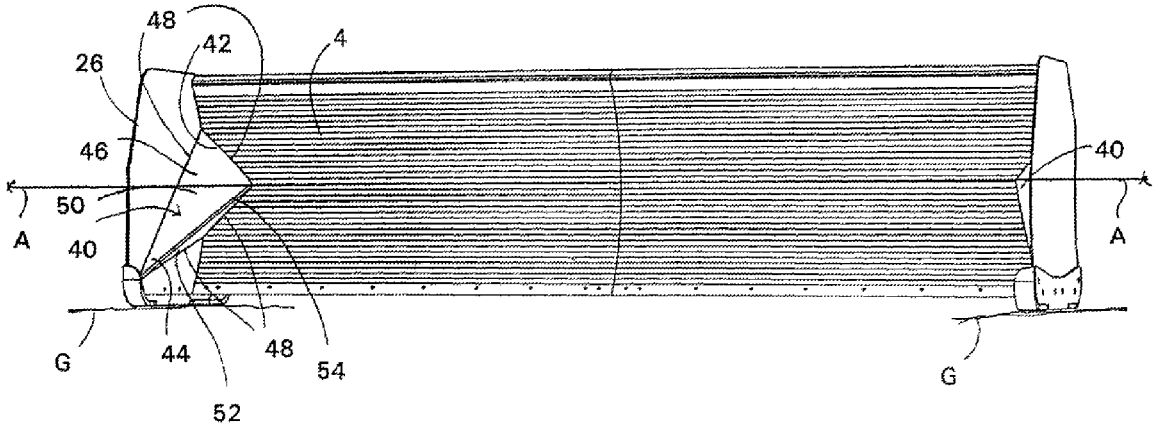

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-6 is confirmed.

* * * * *